United States Patent [19]

Nagai

[11] Patent Number: 4,911,311

[45] Date of Patent: Mar. 27, 1990

[54] DISPLAY STAND WITH VERTICALLY STACKED TRAYS

[75] Inventor: Randall G. Nagai, Chicago, Ill.

[73] Assignee: Westvaco Corporation, New York, N.Y.

[21] Appl. No.: 362,972

[22] Filed: Jun. 8, 1989

[51] Int. Cl.[4] ..... A47F 5/11

[52] U.S. Cl. ..... 211/126; 211/11; 211/132; 211/188; 248/174

[58] Field of Search ..... 248/174; 211/11, 133, 211/132, 126, 194, 188, 72; 108/111

[56] References Cited

U.S. PATENT DOCUMENTS

| | | | |
|---|---|---|---|
| 2,490,269 | 12/1949 | Johnson | 211/126 |
| 3,847,458 | 11/1974 | Nowak | 211/188 X |
| 4,074,810 | 2/1978 | Juergens et al. | 211/126 X |
| 4,138,015 | 2/1979 | Rabley | 211/126 X |
| 4,480,756 | 11/1984 | Belokin | 211/133 X |
| 4,753,341 | 6/1988 | McIntyre | 211/133 X |
| 4,813,536 | 3/1989 | Willis | 211/132 X |

*Primary Examiner*—Robert W. Gibson, Jr.

[57] ABSTRACT

A collapsible display stand and container comprises a base member onto which a plurality of trays are stacked. The trays are separated from one another at two opposed sides by panels which support and space the trays from one another, and a riser member is attached to the top of the uppermost tray. The tray elements are formed from separate cut and scored blanks of corrugated paperboard or the like, and include slots in the upper and lower edges of two opposed side walls for accommodating locking tabs integral with the support/spacer panels. The support/spacer panels are also formed from separate cut and scored blanks of corrugated paperboard or the like. Each element of the invention can be collapsed for shipment and set up at the point-of-use by hand for accommodating the desired product. Alternatively, the elements of the invention can be set up and loaded with product prior to shipment. As product is sold, the empty trays and support/-spacer elements can be removed from the display stand or restocked.

3 Claims, 3 Drawing Sheets

10
11
12
12
13
13
14
15
15

DISPLAY STAND WITH VERTICALLY STACKED TRAYS

BACKGROUND OF INVENTION

The present invention relates generally to display stands, and more particularly to a display stand having a plurality of vertically stacked trays.

Prefabricated display stands are commonly used for displaying merchandise for sale in retail establishments, particularly supermarkets. It is well known to make such display stands from corrugated paperboard or similar material that is low in cost and of light weight constructions.

Although many vertical display stands and assemblies are known in the prior art, many have objectionable features. For instance, some do not stack well or interest with one another, and are generally not suitable for shipping and storing the articles promoted for sale. Other display stands known in the art are manufactured only in a single size and cannot be adjusted to accommodate different locations in the stores. Moreover, many known display stands are formed in several pieces that require complex assembly instructions.

Examples of such prior art display stands are modular displays as shown in U.S. Pat. Nos. 4,182,244 and 4,630,740, and an interlocking vertical display as shown in U.S. Pat. No. 3,862,689.

The present invention is specifically directed to be an improvement in the prior art display devices and for the purpose of overcoming the above mentioned short comings of the prior art.

SUMMARY OF INVENTION

According to the present invention, the display stand comprises a separate base element of generally rectangular configuration which is designed to support a plurality of low profile tray elements which are interlocked with and separated by a plurality of individual support/-spacer panels, with a riser member detachable connected to the uppermost tray. The tray elements are form from one piece cut and scored blanks of corrugated paperboard which are generally symmetrical. The front and rear walls of each tray element have cut away central sections for good visibility of, and easy access to the stored products. The side walls of the tray are each of double thickness and are arranged to be self locking. When set up, the tray side walls each include centrally located slots along their upper and lower edges for accommodating tabs provided on the separate support/spacer panels. The support/spacer panels are also formed from separate blanks of cut and scored corrugated paperboard and include upper and lower tabs for interlocking upper and lower trays together. During assembly of the display stand, the support/-spacer panels are arranged in pairs, one at each side of each tray. In the final construction one support/spacer panel pair with locking tabs only along its lower edge is provided for the uppermost tray.

It is, therefore, a principal object of the present invention to provide a vertical display stand in which individual tray elements are stacked one on top of the other, with intermediate paired support/spacer panels therebetween to form a stable, interlocked display assembly.

It is another object of the present invention to provide a vertical display stand having components which can readily be converted from the collapsed condition to their display state without the use of tools, staples, or other types of fasteners.

It is a related object of the present invention to provide a display container in which the articles to be displayed may be shipped in the converted display stand and stored prior to set up at the point of purchase. The display container is especially suitable for the shipping and storage of packaged food products and other articles for which an upright position is preferred.

These and other objects, features and advantages of the present invention will become apparent from the following detailed description and drawing.

DETAILED DESCRIPTION

Figure 1:
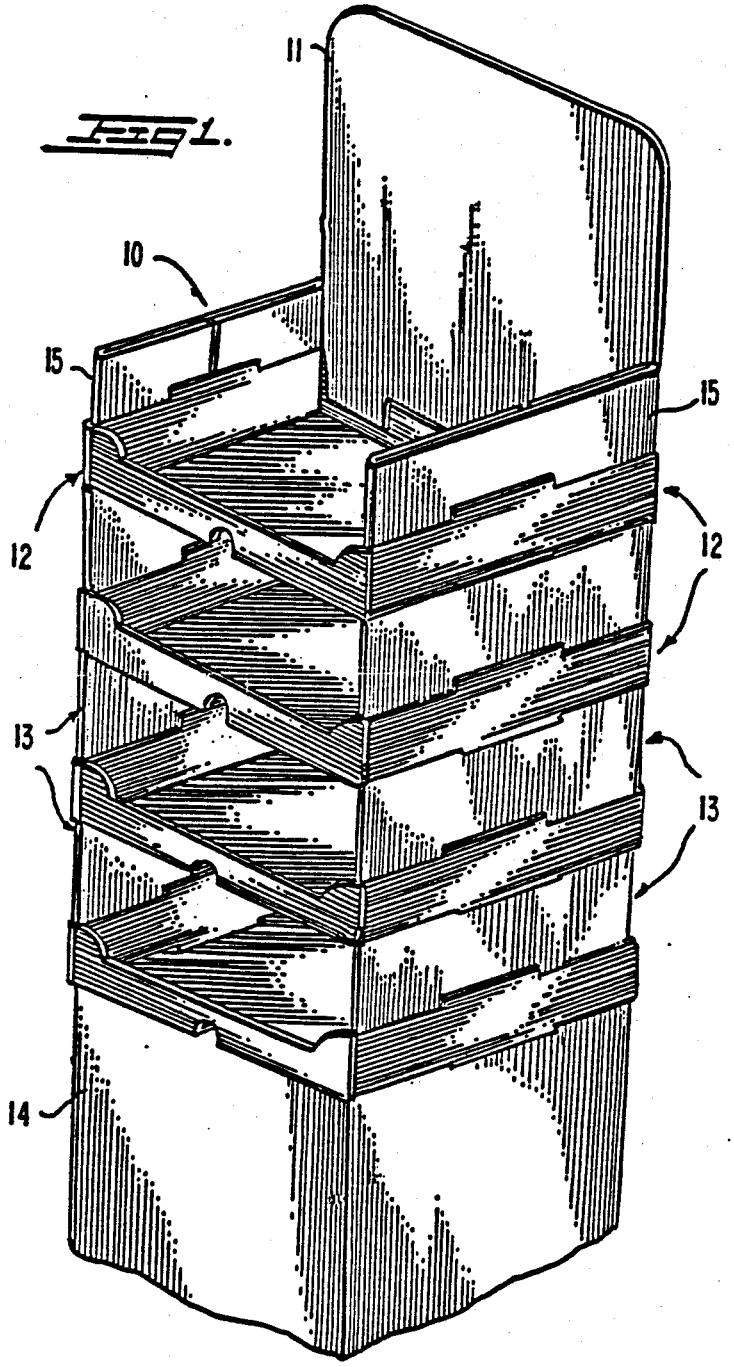
FIG. 1 is a perspective view of a vertical display stand/container embodying the features of the present invention.

With reference to FIG. 1, reference character 10 denotes the vertical display stand/container of the present invention. It will be seen that the display stand comprises a plurality of low profile tray elements 12 stacked on a base member 14 and separated by a plurality of intermediate pairs of support/spacer elements 13 which interlock the trays 12 together. At the top of the display stand there is located a riser panel 11 which is frictionally connected to the uppermost tray 12 and a pair of side wall panels 15 located adjacent to the riser panel 11 which extend above the uppermost tray 12. The riser panel 11 is incorporated into the display stand for the purpose of providing space onto which promotional and advertising material may be printed and the base member 44 is provided to support the trays 12 at an elevation above the floor convenient for access to the product offered for sale (not shown). In at least one embodiment of the present invention the product is stored in the trays prior to shipment so that the display stand is ready for use when received. In another embodiment, the display stand is set up for use at the point of purchase substantially as shown in FIG. 2

Figure 2:
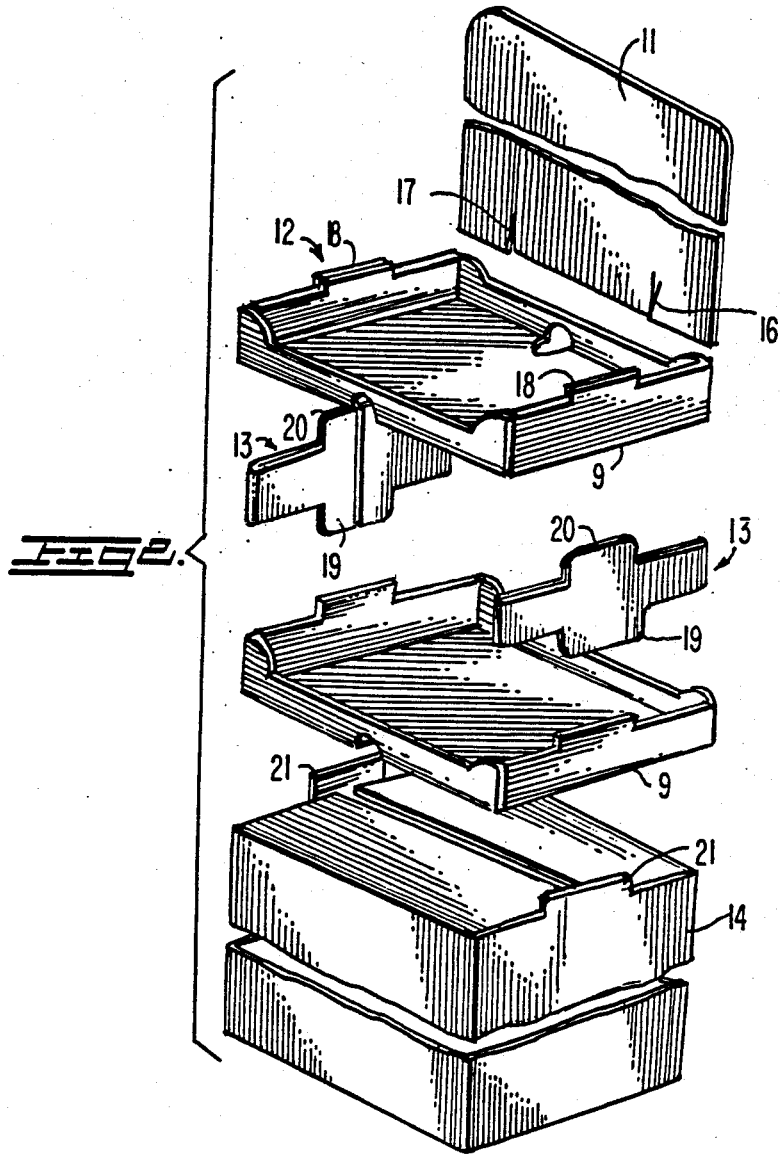
FIG. 2 is an expanded view in perspective showing different components of the invention.

In the expanded view shown in FIG. 2, typical examples of trays and support/spacer elements provided for the display stand of the present inventions are illustrated. Note that the riser panel 11 includes a pair of slits 16, 17 at its lower edge so that it may be frictionally attached to the rear wall of the uppermost tray element 12, and the base member 14 includes a pair of integral tab elements 21, 21 which are adapted to be engaged with the lowermost tray element. The trays each include slots 18, 18 along the upper edges of their side walls and slots 9,9 along the lower edges of their side walls. These slots are adapted to accommodate tab elements 19, 19 and 20, 20 on the support/spacer panels 33 for interlocking the trays and support panels together.

Figure 3:
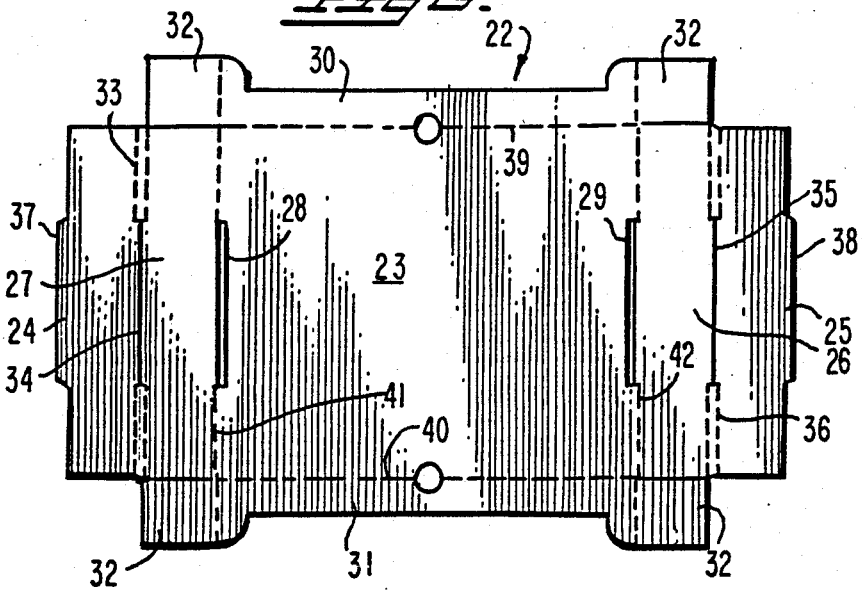
FIG. 3 is a plan view of a typical blank structure for forming the tray elements of the present invention.

FIG. 3 illustrates a typical blank structure useful for forming the tray element 12 of the present invention the blank 22 is generally symmetrical in shape and includes a centrally located bottom panel 23 with front and rear walls 30, 31 foldably attached thereto along scored lines 39, 40. Meanwhile, at each side of the bottom panel 23 there are located side wall panels comprising outer panels 26, 27 foldably attached to bottom panel 23 along scored lines 41, 42, and inner panels 24, 25 foldably attached to the outer panels along cut/scored lines 33, 34 and 35, 36. The cut/scored lines 33, 34 at one side of the blank 22 and 35, 36 at the opposite side of blank 22 comprise centrally located cut lines 34, 35 flanked at each end by spaced apart scored lines 33 and 36. This construction provides the slots 18, 18 in the upper edges of the tray side walls when the trays are formed as shown in FIG. 2. In addition, the blank 22 also includes a pair of slots 28, 29 located along fold lines 41, 42 which are designed to cooperate with tabs 37, 38 on the inner side wall panels 24, 25 for locking the tray in its set up condition. The blank 22 is folded as follows to set up the tray. The front and rear walls 30, 31 are folded into their upright condition. The tabs 32 connected to the ends of wall 30, 31 are folded inwardly toward the bottom panel 23 and each side wall is formed by folding the outer panels 26, 27 upwardly about scored lines 41, 42 and the inner panels 24, 25 are folded downwardly about the cut/scored lines 33, 34 and 35, 36 to capture the tabs 32 add allow the tabs 37, 38 to be inserted in slots 28, 29. This folding sequence produces fully set up and rigid tray element 12 without the use of staples, glue or the like. The slots 28, 29 are made large enough to accommodate the tabs 37, 38 and still leave slots 9,9 along the lower edges of the tray side walls for the tabs of the support/spacer element 13. Likewise, the arrangement of a single cut line 34 or 35 at the top of each tray side wall, and the spaced score lines 33 and 36 provide the slots 18, 18 for accommodating the tabs of the support/spacer elements 13.

Figure 4:
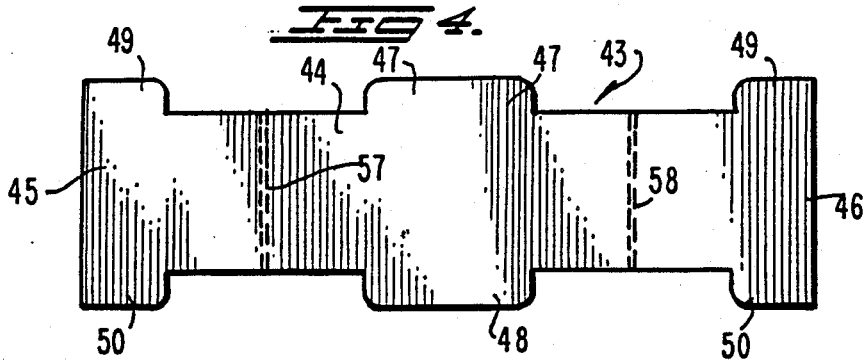
FIG. 4 is a plan view of a typical blank structure for forming the intermediate support/spacer panels of the present invention: and, FIG. 5 is a plan view of a typical blank structure for forming the side panels for the uppermost tray in the display stand/container of the present invention.

The intermediate support/spacer panels of the invention are preferably formed from the blank shown in FIG. 4. The blank 43 comprises a central portion 44 with wing portions 45, 46 separated from the central portion by spaced score lines 57, 58. Integral with the central portion 44 are enlarged areas 47, 48 top and bottom, while the wing portions of the blank include half-sized portions of the blank including half-sized enlarged areas 49, 50. When the wing portions 45, 46 are folded along score lines 57, 58 to lie adjacent to central portion 44, the enlarged areas of the blank form the tab elements 19, 20 shown in FIG. 2.

Figure 5:
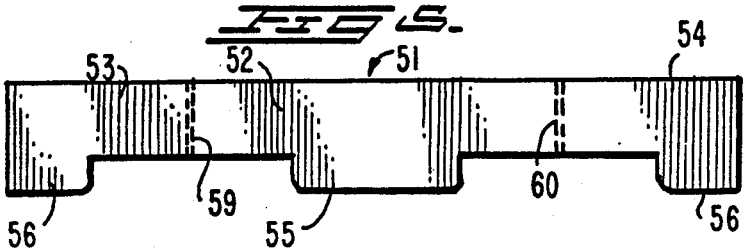

FIG. 5 shows the blank construction for the side wall extensions used on the uppermost tray 12. Essentially blank 51 of FIG. 5 is the same as blank 43 of FIG. 4 except there are no enlarged areas on the upper edges of the blank since no top tabs are required. Blank 51 comprises a central portion 52 with an enlarged area 55 on the lower edge thereof to form a single lower tab. Attached to the central portion 52 are wing portions 53, 54 along scored lines 59, 60. Finally, half-sized enlarged areas 55, 56 are included on the wing portions 53, 54 which when folded form a lower tab element 19.

It will be understood that each display stand/container may comprise as many trays and intermediate support/spacer panels as desired. When the trays are filled before shipping, the entire structure including the base, but with the riser panel detached, may be shipped intact. At the point of purchase, it is only necessary to remove the outside wrapping, attach the riser panel to the top of the uppermost tray, and leave the display stand in the desired location. As each tray of product is sold, the tray and attendant intermediate support/-spacer panels are removed and the side wall extensions replaced in the then remaining uppermost tray.

While only one specific embodiment of the invention has been fully disclosed, it will be appreciated that various changes and modifications may be made in the construction without departing form the spirit of the invention as defined in the appended claims.

What is claimed is:

1. A vertical display stand comprising in combination:

(a) a substantially rectangular base member;

(b) a plurality of individual, substantially rectangular product trays arranged to be stacked vertically on said base member, said base member and lowermost tray including a first cooperating means for fixing the position of the lowermost product tray on said base member said first cooperating means comprising integral tab elements formed from two opposed side walls of said base member which extend above the base member for engagement in slots provided on the lower edges of the side walls of said lowermost tray; and (c) a plurality of intermediate support/spacer panels positioned between each of said trays above the lowermost tray, said support/spacer panels being arranged in vertical pairs between the said walls of each tray, said support/spacer panels and trays each including a second cooperating means for fixing the trays in their vertical position said second cooperating means comprising integral tab elements formed on the upper and lower edges of each support/spacer panel which extend above and below the panel for engagement in slots provided on the upper and lower edges of the side walls of each tray element.

2. The display stand of claim 1 comprising further in combination:

(d) a pair of side wall extensions arranged to fit on top of the side walls of the uppermost tray in said vertical stack said side wall extensions including tabs formed along the lower edges thereof for engagement in slots provided on the side walls of the uppermost tray.

3. The display stand of claim 2 comprising further in combination:

(e) a riser panel arranged to fit over the rear wall of the uppermost tray and including spaced slits in the lower edge thereof which form a central panel portion that overlaps the rear wall of the uppermost tray.

* * * * *